US011311101B2

(12) United States Patent
Leng

(10) Patent No.: US 11,311,101 B2
(45) Date of Patent: Apr. 26, 2022

(54) FOLDING TABLE

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Fujian (CN)

( * ) Notice: Subject to any disclaimer, the term of this patent is extended or adjusted under 35 U.S.C. 154(b) by 0 days.

(21) Appl. No.: 15/475,395

(22) Filed: Mar. 31, 2017

(65) Prior Publication Data

US 2018/0279768 A1 Oct. 4, 2018

(51) Int. Cl.
*A47B 3/083* (2006.01)
*A47B 3/087* (2006.01)

(52) U.S. Cl.
CPC ..... *A47B 3/087* (2013.01); *A47B 2003/0835* (2013.01); *A47B 2200/0037* (2013.01)

(58) Field of Classification Search
CPC ..... A47B 3/087; E06C 1/32
USPC ..... 108/166–170; 16/328
See application file for complete search history.

(56) References Cited

U.S. PATENT DOCUMENTS 4,403,373 A * 9/1983 Kummerlin ..... E06C 1/32 16/326
4,566,150 A * 1/1986 Boothe ..... E05D 11/1007 16/332
4,666,327 A * 5/1987 Su ..... E06C 1/32 16/324
4,697,305 A * 10/1987 Boothe ..... E06C 1/32 16/329
6,058,853 A * 5/2000 Pinch ..... A47B 3/087 108/129
7,278,515 B2 * 10/2007 Moser ..... E04G 1/28 108/169
7,634,969 B2 * 12/2009 Neunzert ..... A47B 3/00 108/132

* cited by examiner

*Primary Examiner* — Matthew W Ing
(74) *Attorney, Agent, or Firm* — Cooper Legal Group, LLC

(57) ABSTRACT

A folding table has two table tops. A connecting piece of one table top is rotatably pivoted to a facing connecting piece of the other table top, wherein the connecting piece and the facing connecting piece are respectively disposed with a lock hole, the lock hole of the connecting piece is aligned with the lock hole of the facing connecting piece when the two table tops are unfolded; further comprising a lock element synchronously inserted to the lock hole of the connecting piece and the lock hole of the facing connecting piece to lock the connecting piece and the facing connecting piece and an elastic element to apply elastic force on the lock element to keep the lock element in the lock holes. The elastic element forces the lock element to be synchronously inserted to the two lock holes to lock the connecting piece and the facing connecting piece.

12 Claims, 7 Drawing Sheets

FOLDING TABLE

FIELD OF THE INVENTION

The present invention relates to a folding table.

BACKGROUND OF THE INVENTION

Tables are necessary accessories in people's daily life. Traditional tables are composed of a single table top and several support legs. As the table top has large area, the table occupies large space when being stored, and is also inconvenient to transport. To solve the problems, there are folding tables in the market. This kind of folding tables comprises two table tops, when the table is used, the table tops are unfolded, when it is not needed, the table tops are folded for storage.

Although the existing folding table can have the two table tops be folded to reduce the storage space, the two table tops are not as constrained, two table tops are easy to rotate relatively, therefore, the table is used with bad stability.

SUMMARY OF THE INVENTION

The present invention is provided with a folding table with lock function, which overcomes the disadvantages of the traditional technology. The technical solution of the present invention is that:

A folding table, comprising two table tops, a connecting piece of one table top is rotatably pivoted to a facing connecting piece of the other table top, wherein the connecting piece and the facing connecting piece are respectively disposed with a lock hole, the lock hole of the connecting piece is aligned with the lock hole of the facing connecting piece when the two table tops are unfolded; further comprising a lock element synchronously inserted to the lock hole of the connecting piece and the lock hole of the facing connecting piece to lock the connecting piece and the facing connecting piece and an elastic element to apply elastic force on the lock element to keep the lock element in the lock holes.

In another preferred embodiment, the lock element comprises a rotating shaft, a pressing cover and a lock catch, the rotating shaft passes through the connecting piece and the facing connecting piece, the pressing cover and the lock catch are respectively connected to the two ends of the rotating shaft, the elastic element is sleeved on the rotating shaft.

In another preferred embodiment, the connecting piece comprises two lock holes symmetrically arranged about the rotating shaft; the facing connecting piece comprises two lock holes symmetrically arranged bout the rotating shaft; the lock catch is shaped, two ends of the lock catch are respectively disposed with a hock portion used to insert to the lock hole.

In another preferred embodiment, the bottom portion of one table top is disposed with a snap joint, the bottom portion of the other table top is disposed with a facing snap joint, the snap joint is locked to the facing snap joint when the two table tops are folded and contacted.

In another preferred embodiment, the connecting piece and the facing connecting piece are pivoted by the rotating shaft.

In another preferred embodiment, the table top comprises a top surface and a bottom surface bonding together, the interior of the table top is embedded with a metal frame along the periphery, the connecting piece and the facing connecting piece are connected to the metal frame.

Compared to the traditional technology, the technical solution of the present invention has following advantages:

1. The elastic element applies force on the lock element to make the lock element synchronously inserted to the two lock holes to lock the connecting piece and the facing connecting piece, such that the two table tops can not rotate relatively, when they are unfolded and used, the stability performance is better.

2. The connecting piece comprises two lock holes symmetrically arranged about the rotating shaft; the facing connecting piece comprises two lock holes symmetrically arranged bout the rotating shaft. The lock catch 26 is shaped, two ends of the lock catch are respectively disposed with a hock portion used to insert to the lock hole. Therefore, when the two table tops are folded and contacted together, the lock holes of the two table tops are aligned, the hock portions are inserted to the lock holes to lock to the connecting piece and the facing connecting piece, making the two table tops tightly contacted together when the two table tops are folded and to prevent two table tops open automatically.

3. The bottom portion of one table top is disposed with a snap joint, the bottom portion of the other table top is disposed with a facing snap joint, the snap joint is locked to the facing snap joint when the two table tops are folded and contacted, thus preventing the two table tops open automatically.

BRIEF DESCRIPTION OF THE DRAWINGS

The present invention will be further described with the drawings and the embodiments.

DETAILED DESCRIPTION OF THE EMBODIMENTS

Figure 1:
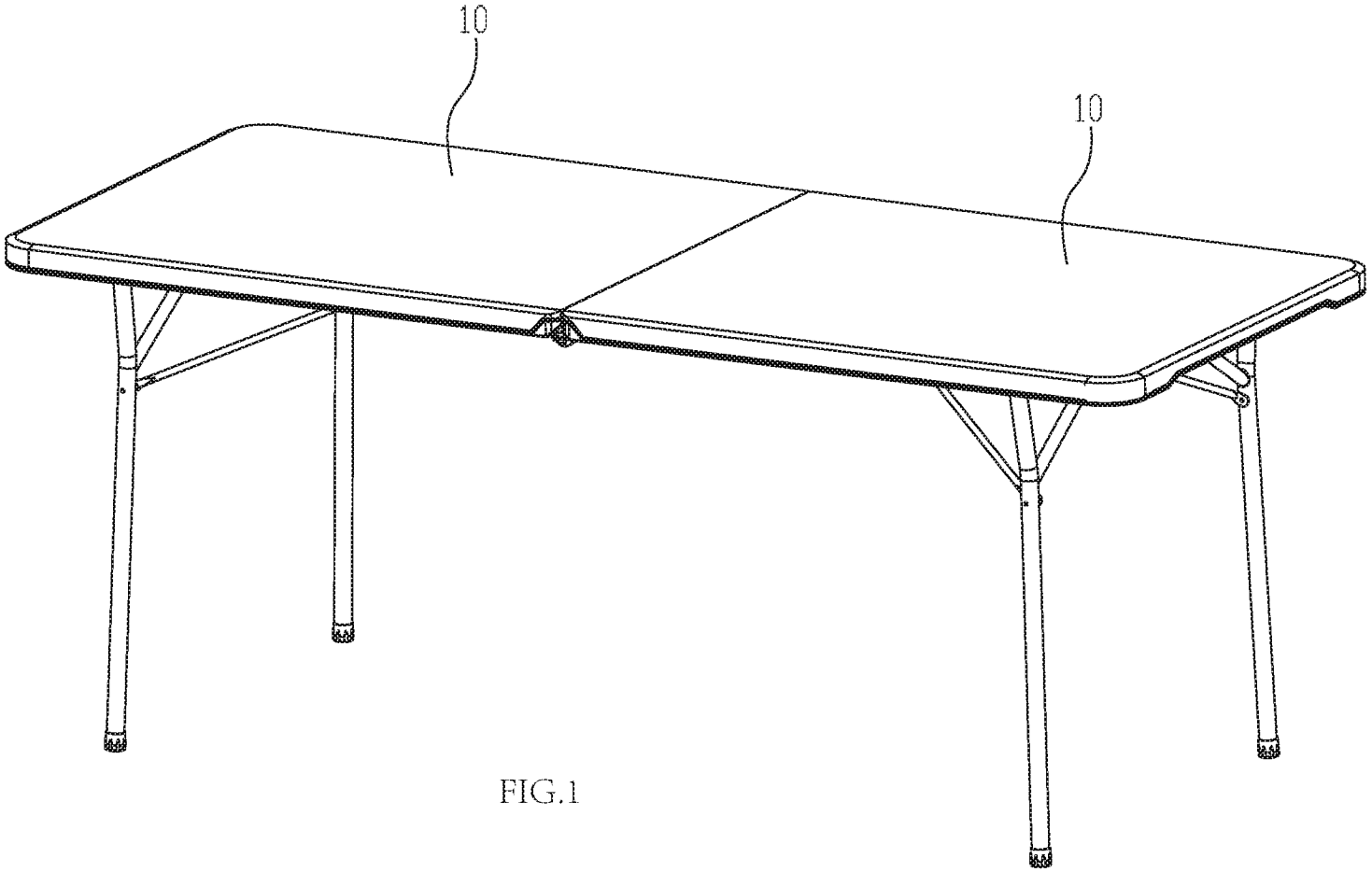
FIG. 1 illustrates a schematic diagram of a folding table of the present invention.
Figure 2:
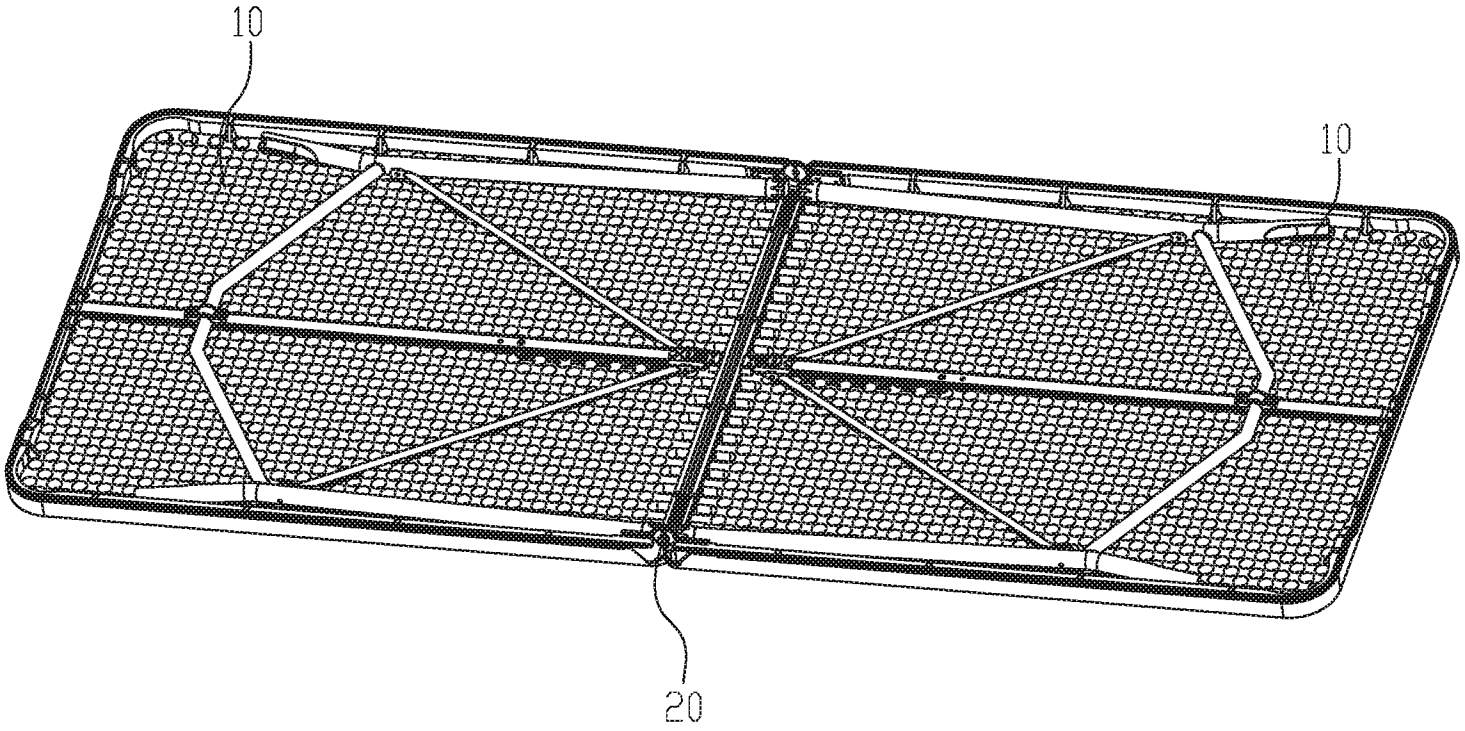
FIG. 2 illustrates a schematic diagram of the folding table of FIG. 1 with the table legs folded.
Figure 3:
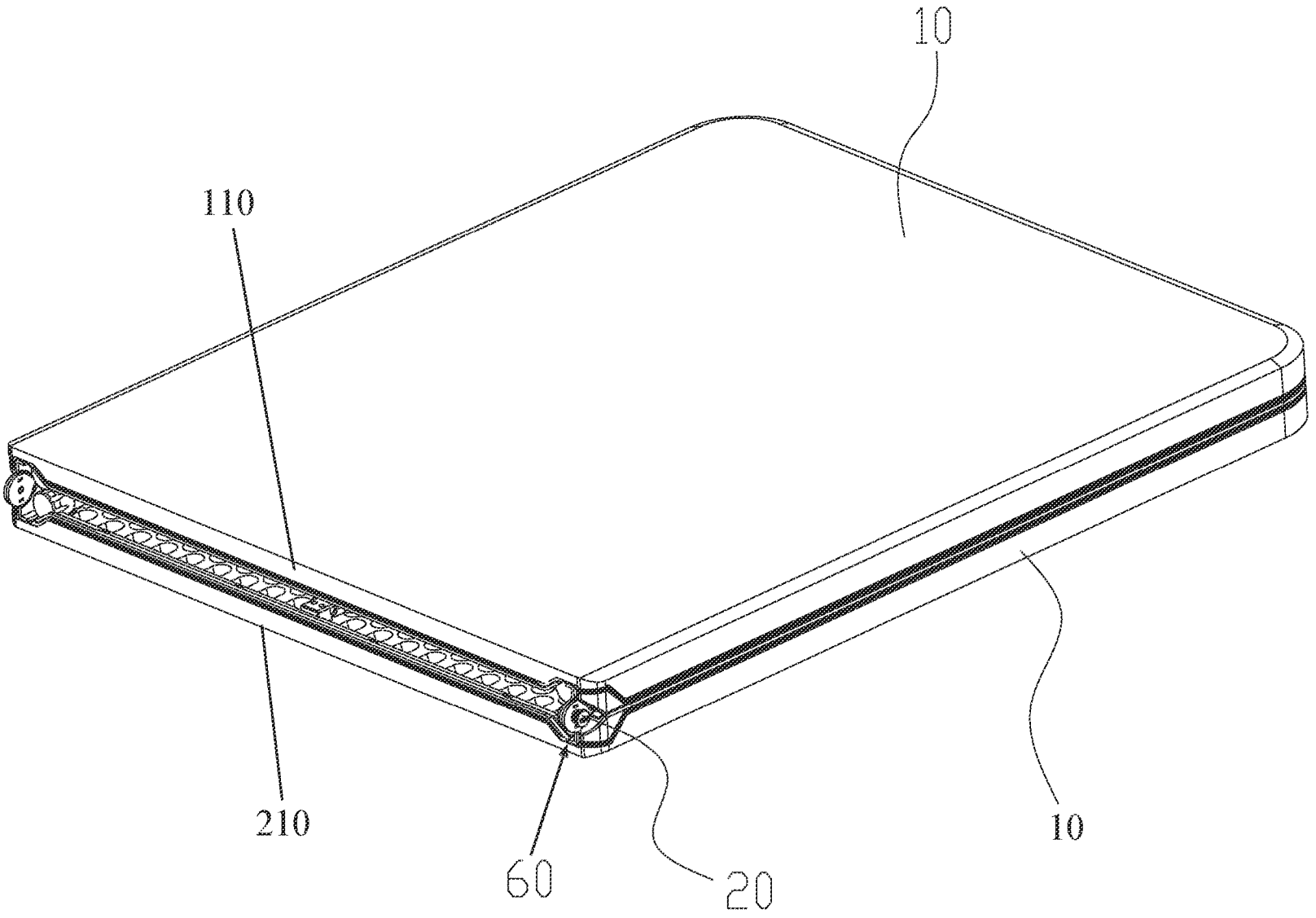
FIG. 3 illustrates a schematic diagram of the folding table of FIG. 1 with the two table tops folded.
Figure 4:
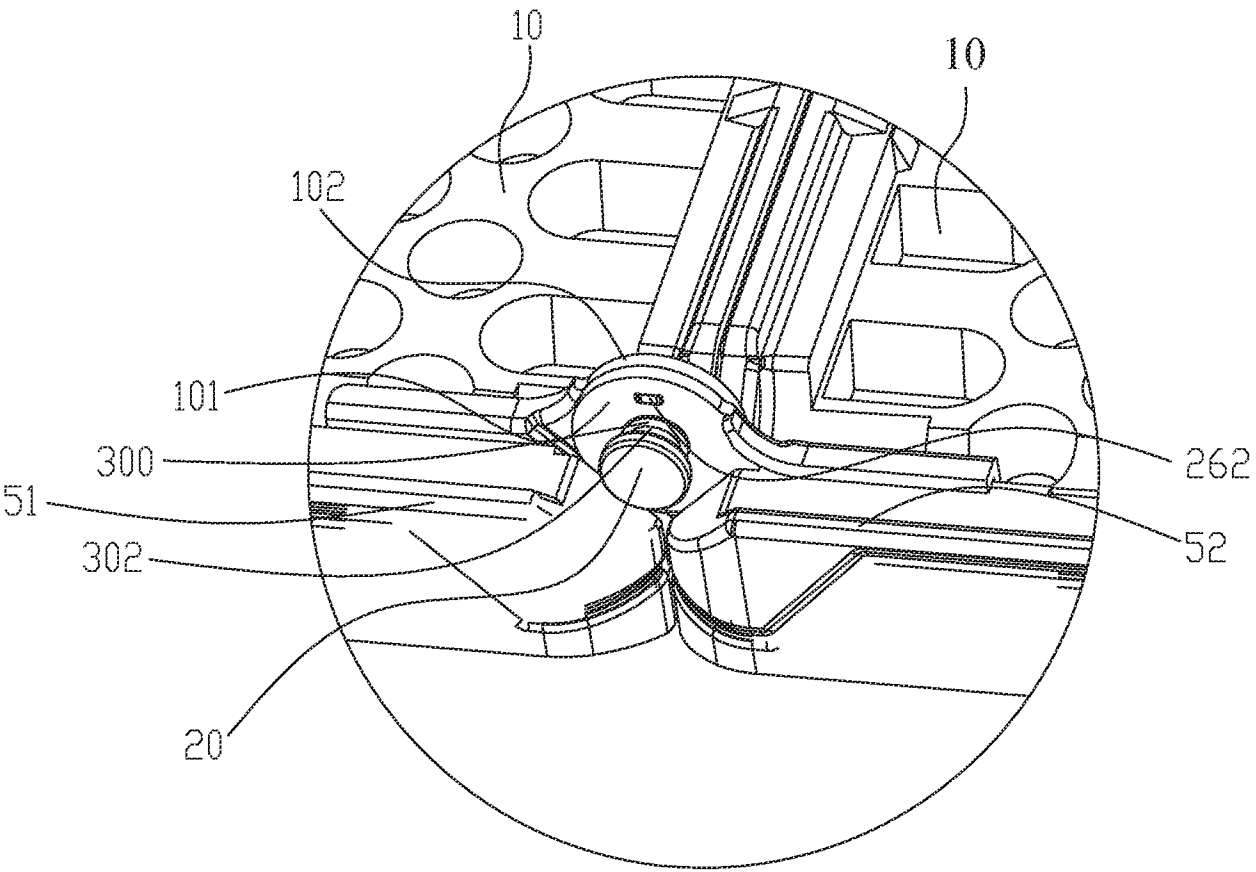
FIG. 4 illustrates a partial enlargement diagram of the folding table of FIG. 1.

Please referring to FIGS. 1-6, a folding table of the present invention comprises two table tops 10, a connecting piece 101 of one table top 10 is rotatably pivoted to a facing connecting piece 102 of the other table top 10, therefore, two table tops 10 can be folded and unfolded. The connecting piece 101 and the facing connecting piece 102 are respectively disposed with a lock hole 103, the lock hole 103 of the connecting piece 101 is aligned with the lock hole 103 of the facing connecting piece 102 when the two table tops 10 are unfolded; further comprising a lock element 20 synchronously inserted to the lock hole 103 of the connecting piece 101 and the lock hole 103 of the facing connecting piece 102 to lock the connecting piece 101 and the facing connecting piece 102 and an elastic element 30 to apply elastic force on the lock element 20 to keep the lock element 20 in the lock holes 103.

Less than half of a side of the connecting piece 101 and less than half of a side of the facing connecting piece 102 are directly and fixedly connected to inner sides of the two table tops 10, and more than half of the connecting piece 101 and more than half of the facing connecting piece 102 are disposed below lower surfaces of the two table tops 10 to which the connecting piece 101 and the facing connecting piece 102 are directly connected. Outer edges of the lower surfaces of the two table tops 10 protrude downward to define a first protruding edge 51 and a second protruding edge 52, and a total of a thickness of the first protruding edge 51 and a thickness of the second protruding edge 52 is equal to or more than a height of the more than half of the connecting piece 101 or the more than half of the facing connecting piece 102. The lock element 20 comprises a rotating shaft 22, a pressing cover 24 and a lock catch 26. The rotating shaft 22 passes through the connecting piece 101 and the facing connecting piece 102, the pressing cover 24 and the lock catch 26 are respectively connected to the two ends of the rotating shaft 22, and the elastic element 30 is sleeved on the rotating shaft 22. The connecting piece 101 and the facing connecting piece 102 are pivoted by the rotating shaft 22. A mounting base 300 of the lock element 20 comprises a mounting groove 301. Laterally among the connecting piece 101, the facing connecting piece 102 and the mounting base 300, merely a first center hole 105 of the connecting piece 101 and a second center hole 106 of the facing connecting piece 102 surround the mounting groove 301. The rotating shaft 22 movably passes through a third center hole 302 of the mounting base 300, and the rotating shaft 22 is separated from the connecting piece 101 and the facing connecting piece 102 by the mounting groove 301. A side surface of the first table top 10 facing the second table top 10 defines a first positioning member 110, and a side surface of the second table top 10 facing the first table top 10 defines a second positioning member 210. When the two table tops 10 are fully folded, a receiving space 60 configured to receive the connecting piece 101 and the facing connecting piece 102 is defined between the lower surfaces of the two table tops 10 at least due to the first protruding edge 51 and the second protruding edge 52.

Figure 5:
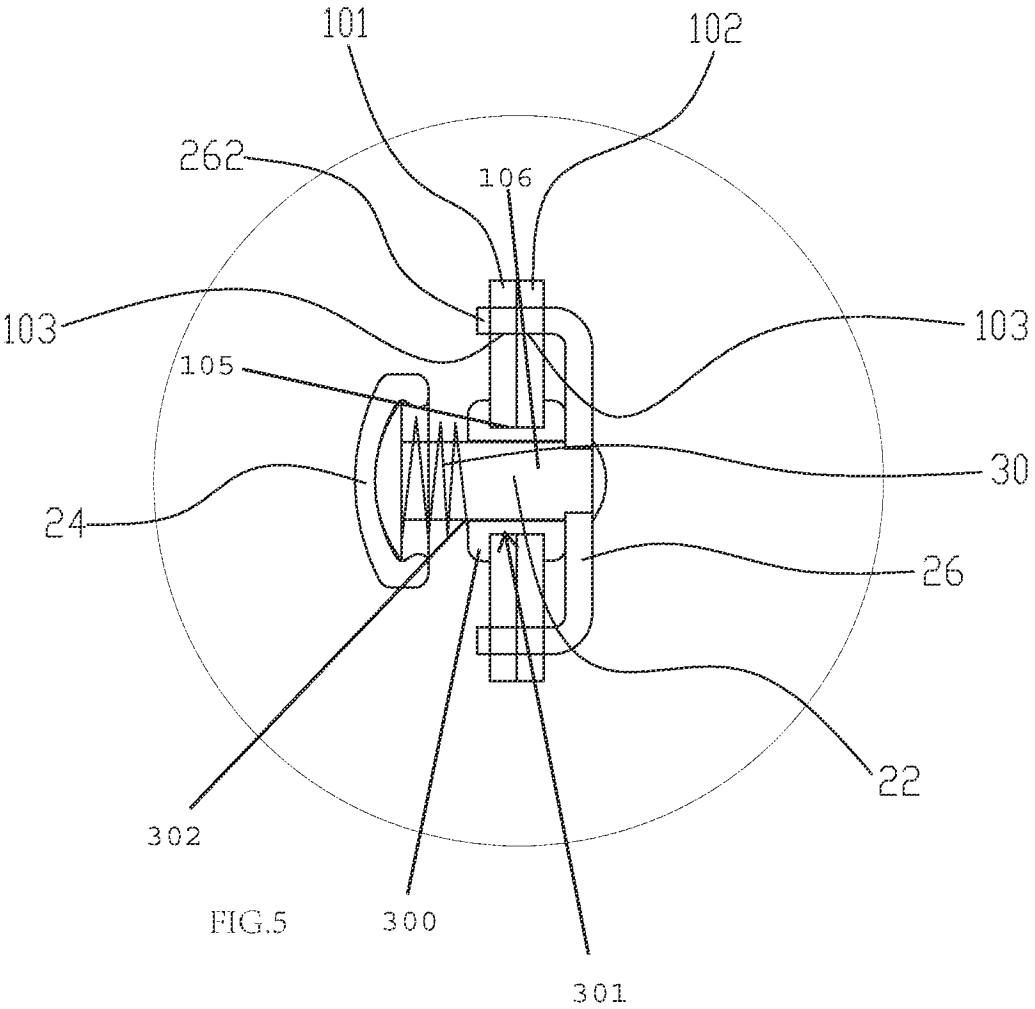
FIG. 5 illustrates a schematic diagram of the lock element of the folding table of FIG. 1 locking to the connecting piece and the facing connecting piece.
Figure 6:
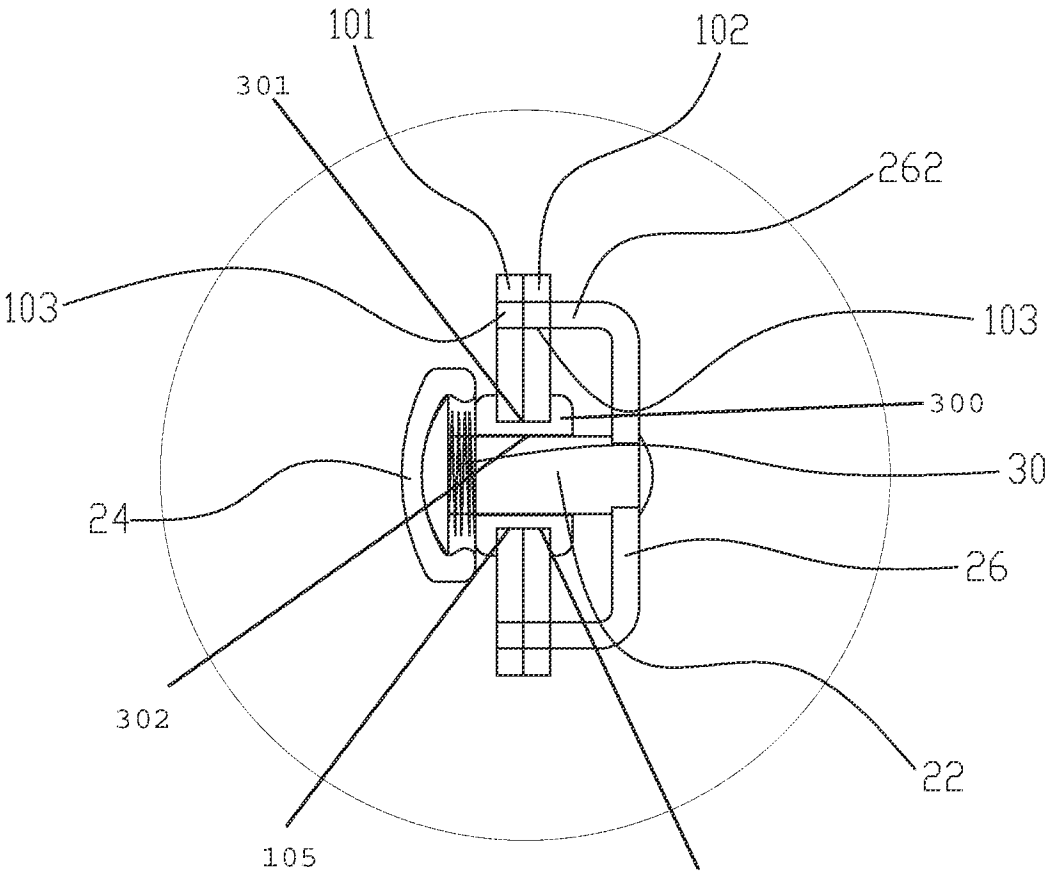
FIG. 6 illustrates a schematic diagram of the lock element of the folding table of FIG. 1 unlocking to the connecting piece and the facing connecting piece.

Preferred, the connecting piece 101 comprises two lock holes 103 symmetrically arranged about the rotating shaft 22; the facing connecting piece 102 comprises two lock holes 103 symmetrically arranged about the rotating shaft 22; two lock holes 103 of the connecting piece 101 are respectively aligned with the two lock holes 103 of the facing connecting piece 102 when the two table tops 101 are unfolded and folded. The lock catch 26 is] shaped, two ends of the lock catch 26 are respectively disposed with a hock portion 262 used to insert to the lock hole. As illustrated in FIG. 6, the lock catch 26 has two L-shaped arms 264 in relation to the center 200 of the rotating shaft 22. Each of the two L-shaped arms 264 has a parallel portion 266 which is generally parallel to the connecting pieces 101 and 102. At the location corresponding to the lock holes 103, the rotating catch 26 extends and bends 90 degree to form the hock portion 262. As shown in FIGS. 5 and 6, the parallel portion 266 and the hock portion 262 may be a single L-shaped continuous piece, whereby the hock portion 262 is perpendicular to the parallel portion 266. When the pressing cover 24 is pressed down, the lock element 20 overcomes the elastic force of the elastic element 30 and moves, thus driving the hock portion 262 moves out of the lock hole 103.

The lock catch 26 is shaped, two ends of the lock catch 26 are respectively disposed with a hock portion 262 used to insert to the lock hole. When the pressing cover 24 is pressed down, the lock element 20 overcomes the elastic force of the elastic element 30 and moves, thus driving the hock portion 262 moves out of the lock hole 103.

Preferred, the table top 10 comprises a top surface and a bottom surface bonding together, the interior of the table top 10 is embedded with a metal frame along the periphery, the connecting piece 101 and the facing connecting piece 102 are connected to the metal frame.

Figure 7:
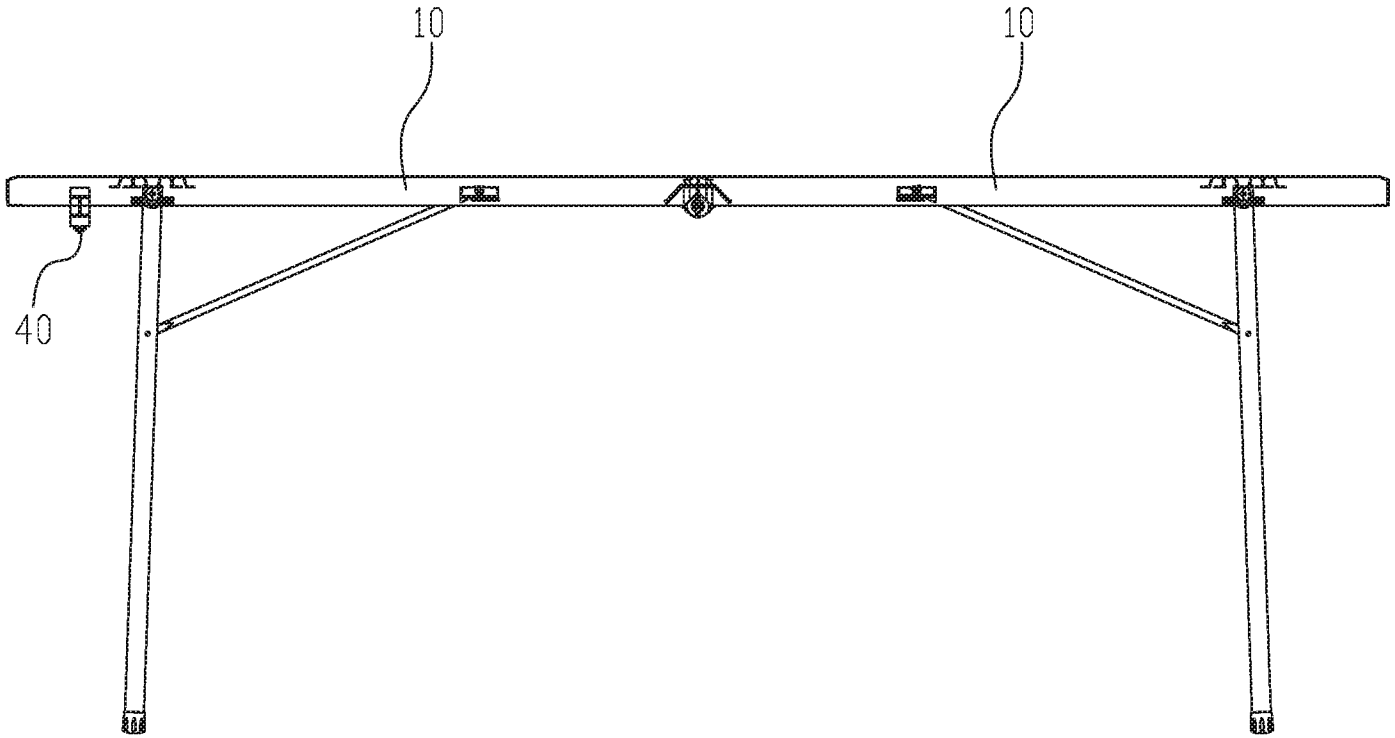
FIG. 7 illustrates a schematic diagram of a folding table of another embodiment of the present invention.

Referring to FIG. 7, to make the two table tops 10 tightly contacted together when the two table tops 10 are folded and to prevent two table tops 10 open automatically, the bottom portion of one table top 10 is disposed with a snap joint 40, the bottom portion of the other table top 10 is disposed with a facing snap joint 40, the snap joint 40 is locked to the facing snap joint 40 when the two table tops 10 are folded and contacted. To unfold the table, one needs to apply force to open the two tablet tops and separate the snap joint 40 and the facing snap joint.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A folding table, comprising:

two table tops, wherein:

a first table top of the two table tops comprises merely a first single-plate connecting piece, a second table top of the two table tops comprises merely a second single-plate connecting piece, less than half of a side of the first single-plate connecting piece is directly and fixedly connected to an inner side of the first table top, more than half of the first single-plate connecting piece is disposed below a lower surface of the first table top to which the first single-plate connecting piece is directly connected, less than half of a side of the second single-plate connecting piece is directly and fixedly connected to an inner side of the second table top, more than half of the second single-plate connecting piece is disposed below a lower surface of the second table top to which the second single-plate connecting piece is directly connected, an outer edge of the lower surface of the first table top protrudes downward to define a first protruding edge, an outer edge of the lower surface of the second table top protrudes downward to define a second protruding edge, the first single-plate connecting piece pivotally faces the second single-plate connecting piece, the first single-plate connecting piece comprises a first center hole, a first lock hole, and a third lock hole, the first lock hole and the third lock hole are symmetrically arranged about the first center hole, the second single-plate connecting piece comprises a second center hole aligned with the first center hole, a second lock hole, and a fourth lock hole, and the second lock hole and the fourth lock hole are symmetrically arranged about the second center hole;

a lock element comprising:

a mounting base passing through the first center hole and the second center hole, wherein:

the mounting base comprises a mounting groove, and laterally among the first single-plate connecting piece, the second single-plate connecting piece, and the mounting base, merely the first center hole and the second center hole surround the mounting groove;

a rotating shaft movably passing through a third center hole of the mounting base;

one or more lock catches, wherein:

the one or more lock catches comprise a first lock catch and a second lock catch, the first lock catch and the second lock catch each includes a parallel portion and a hock portion to define a single L-shaped continuous piece, the hock portion extends from and is perpendicular to the parallel portion, and the hock portion is configured to be inserted into the first lock hole, the second lock hole, the third lock hole, and the fourth lock hole and to lock the first single-plate connecting piece and the second single-plate connecting piece; and a pressing cover disposed on second sides of the first single-plate connecting piece and the second single-plate connecting piece, wherein the pressing cover has a diameter greater than a diameter of the third center hole; and an elastic element disposed on the second sides of the first single-plate connecting piece and the second single-plate connecting piece and outside the first center hole and the second center hole, wherein:

the elastic element directly surrounds the rotating shaft, the elastic element applies an elastic force to the lock element to keep the one or more lock catches in the first lock hole and the second lock hole, the one or more lock catches are outside the first lock hole when the elastic element is pressed, a side surface of the first table top facing the second table top defines a first positioning member, a side surface of the second table top facing the first table top defines a second positioning member, when the two table tops are fully folded:

the first table top overlaps the second table top, the first lock hole is aligned with the second lock hole, the third lock hole is aligned with the fourth lock hole, the first lock catch is configured to be inserted into the first lock hole and the second lock hole, the second lock catch is configured to be inserted into the third lock hole and the fourth lock hole, the first positioning member is aligned with the second positioning member, and ends of the first lock catch and the second lock catch extend out of the first single-plate connecting piece and the second single-plate connecting piece, and when the two table tops are fully unfolded:

the first table top is aligned with the second table top, the first lock hole is aligned with the fourth lock hole, the third lock hole is aligned with the second lock hole, the first lock catch is configured to be inserted into the first lock hole and the fourth lock hole, the second lock catch is configured to be inserted into the third lock hole and the second lock hole, the first positioning member abuts the second positioning member, the ends of the first lock catch and the second lock catch extend out of the first single-plate connecting piece and the second single-plate connecting piece, and a receiving space configured to receive the first single-plate connecting piece and the second single-plate connecting piece is defined between the lower surface of the first table top and the lower surface of the second table top at least due to the first protruding edge and the second protruding edge.

2. The folding table according to claim 1, wherein:

at least one of the two table tops comprises a top surface and a bottom surface bonded together, an interior of the at least one of the two table tops is embedded with a metal frame along a periphery of the at least one of the two table tops, and the first single-plate connecting piece and the second single-plate connecting piece are connected to the metal frame.

3. The folding table according to claim 1, wherein:

the first lock hole, the third lock hole, and the first center hole are linearly aligned along a first straight line, and the second lock hole, the fourth lock hole, and the second center hole are linearly aligned along a second straight line.

4. The folding table according to claim 1, wherein:

the mounting base contacts a first sidewall of the first single-plate connecting piece laying in a first plane perpendicular to an axial direction in which the rotating shaft extends, a first sidewall of the second single-plate connecting piece laying in a second plane perpendicular to the axial direction, a first end surface of the first single-plate connecting piece facing the rotating shaft, and a first end surface of the second single-plate connecting piece facing the rotating shaft.

5. The folding table according to claim 1, wherein a first sidewall of the first single-plate connecting piece laying in a first plane perpendicular to an axial direction in which the rotating shaft extends and a first sidewall of the second single-plate connecting piece laying in a second plane perpendicular to the axial direction are between a first sidewall of the mounting base and a second sidewall of the mounting base.

6. The folding table according to claim 1, wherein an outermost diameter of the elastic element is less than a maximum width of the mounting base as measured in a direction perpendicular to an axial direction in which the rotating shaft extends.

7. The folding table according to claim 6, wherein the diameter of the pressing cover is greater than the maximum width of the mounting base.

8. The folding table according to claim 1, wherein the parallel portion contacts a sidewall of the mounting base.

9. The folding table according to claim 1, wherein:

the first lock hole, the second lock hole, the third lock hole, and the fourth lock hole are rectangular, and cross sections of the first lock catch and the second lock catch are rectangular.

10. The folding table according to claim 1, wherein the first lock hole, the second lock hole, the third lock hole, and the fourth lock hole are disposed on an outer side of a projection surface of the pressing cover.

11. The folding table according to claim 1, wherein:

the first single-plate connecting piece defines a circular shape, and the second single-plate connecting piece defines a circular shape.

12. The folding table according to claim 1, wherein a total of a thickness of the first protruding edge and a thickness of the second protruding edge is equal to or more than a height of the more than half of the first single-plate connecting piece or the more than half of the second single-plate connecting piece.

* * * * *